United States Patent [19]

Larikka

[11] Patent Number: 4,503,693

[45] Date of Patent: Mar. 12, 1985

[54] APPARATUS FOR MAKING A HOLE AND A HOLE-SURROUNDING COLLAR IN THE SIDE OF A PIPE

[75] Inventor: Leo Larikka, Vaasa, Finland

[73] Assignee: G.A. Serlachius Oy, Mantta, Finland

[21] Appl. No.: 354,292

[22] Filed: Mar. 3, 1982

[30] Foreign Application Priority Data

Mar. 10, 1981 [FI] Finland ..... 810749

[51] Int. Cl.[3] ..... B21D 31/02

[52] U.S. Cl. ..... 72/71; 72/70; 72/125

[58] Field of Search ..... 72/67, 68, 70, 71, 115, 72/117, 125, 452; 408/35, 129; 409/185

[56] References Cited

U.S. PATENT DOCUMENTS

| | | | |
|---|---|---|---|
| 336,598 | 2/1886 | Smith | 408/35 |
| 1,694,814 | 12/1928 | Galloway | 408/129 |
| 2,814,964 | 12/1957 | Werth | 409/191 |
| 2,991,551 | 7/1961 | Fogle et al. | 72/71 |
| 3,151,657 | 10/1964 | Beranek | 72/125 |
| 3,342,087 | 9/1967 | Mulot | 408/17 |
| 3,346,894 | 10/1967 | Lemelson | 408/129 |
| 3,704,957 | 12/1972 | Petroff | 408/129 |
| 3,884,060 | 5/1975 | Larikka | 72/71 |
| 4,083,219 | 4/1978 | Combes et al. | 29/157 T |
| 4,132,097 | 1/1979 | Ames | 72/71 |

*Primary Examiner*—Lowell A. Larson

*Attorney, Agent, or Firm*—Christie, Parker & Hale

[57] ABSTRACT

An apparatus for making a hole and a collar in the side of a pipe has a pipe-fastening portion mounted on a stand for holding the pipe and has a hole-making portion for making the hole in the pipe during movement in a first direction. There is also a collaring portion for collaring the edges of the hole during movement in a second direction. The hole-making portion and the collaring portion are mounted on the stand and rotated to produce the desired working action. A variable-speed feeder mounted between the stand and the hole-making and collaring portion effects relative vertical displacement between the stand and pipe-fastening portion and the hole-making and collaring portions. The feeder has a cam element for controlling the rate and extent of the vertical displacement and thereby the movement of the hole-making and collaring portions relative to the pipe. The cam element has a cam surface for forcing the collaring portion to effect a movement thereof in the second direction for forming the collar on the pipe. The cam surface limits the movement of the feeder in the first direction.

15 Claims, 7 Drawing Figures

Fig. 4
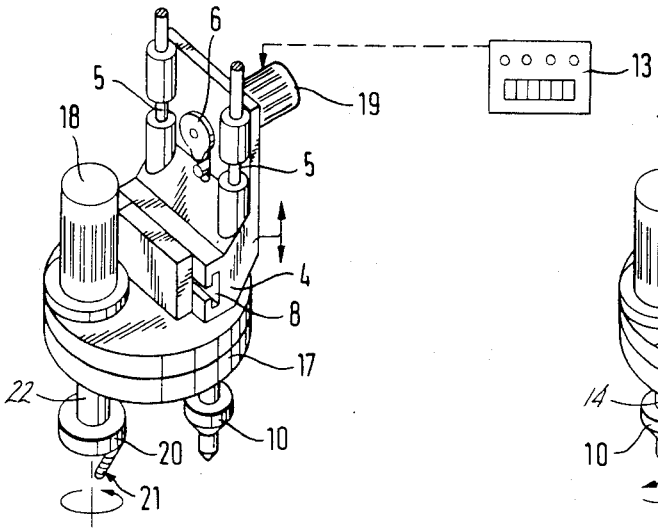
Fig. 5
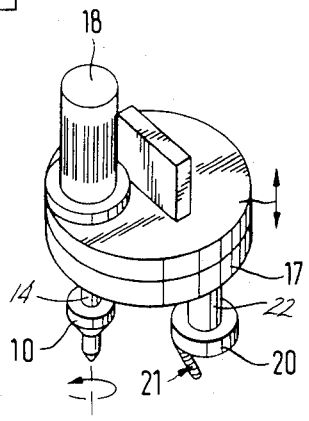
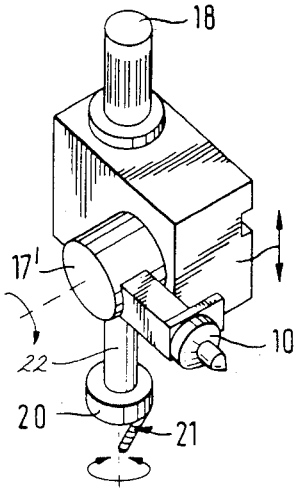
Fig. 6
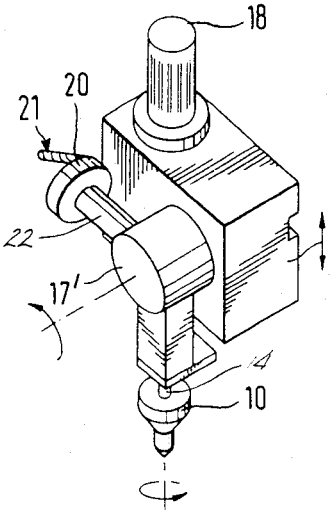
Fig. 7

APPARATUS FOR MAKING A HOLE AND A HOLE-SURROUNDING COLLAR IN THE SIDE OF A PIPE

FIELD OF THE INVENTION

The present invention relates to an apparatus for making a hole and a hole-surrounding collar in the side of a pipe.

BACKGROUND OF THE INVENTION

An apparatus of the above type is disclosed in DE Patent publication No. 1 752 749 corresponding to U.S. Pat. Nos. 3,592,038 and 3,714,808. In that disclosure, the stand of the apparatus is supported by means of support legs which lean against a pipe and are arranged to be displaced relative to said stand by means of a feed screw for producing a vertical movement mechanically during the collaring operation. Such an arrangement is practical for manually operated equipment but it is not the best possible solution for large equipment with fixed stands and intended for mass production. The vertical movements of working heads, i.e., both downward displacement of means for making a hole and upward displacement of shaping means for making a collar, require different optimum speeds.

Thus, the object of the present invention is to provide a structurally simple apparatus, wherein said vertical movements can be controlled and programmed to be optimum in various steps of operation.

SUMMARY OF THE INVENTION

An embodiment of the invention comprises a stand, pipe-fastening means mounted on the stand, hole-making means, collaring means, and means mounted on the stand for mounting and rotating the hole-making means and for mounting and rotating the collaring means, the means for mounting and rotating the hole-making means being drawn by its weight, in a first direction, for hole-making. The apparatus further comprises variable-speed feed means for comprising a cam element for effecting a relative vertical displacement between the mounting and rotating means and the pipe-fastening means. The feed means further comprises a cam surface on the cam element for forcing the collaring means to move in a second direction during a collaring operation, the cam surface being adapted to limit the movement of the mounting and rotating means in the first direction during the hole-making. By virtue of this arrangement, it is possible, by controlling the shape and/or travelling speed of said profile element, to obtain controlled optimum speeds for the following steps of operation:

- instant shift into a hole-drilling position from an initial standby position
- drilling feed at optimum speed in various steps of drilling
- instand shift into a collaring position after the drilling operation
- collaring feed at optimum speed in various steps of collaring
- instant shift into initial position (further away from a workpiece).

BRIEF DESCRIPTION OF THE DRAWINGS

The invention is further illustrated in the following description of some embodiments of the invention with reference being made to the accompanying drawings. In the drawings.

FIGS. 4 and 5 show an alternate embodiment of the invention with the arrangement of hole-working means and collar-forming means fitted on a rotatable element in descrete elements, so that the means can be alternately shifted into the same working position to be driven by the same drive motor; and FIGS. 6 and 7 illustrate another alternative embodiment for the discrete elements of FIGS. 4 and 5.

DETAILED DESCRIPTION OF THE PREFERRED EMBODIMENT

Figure 1:
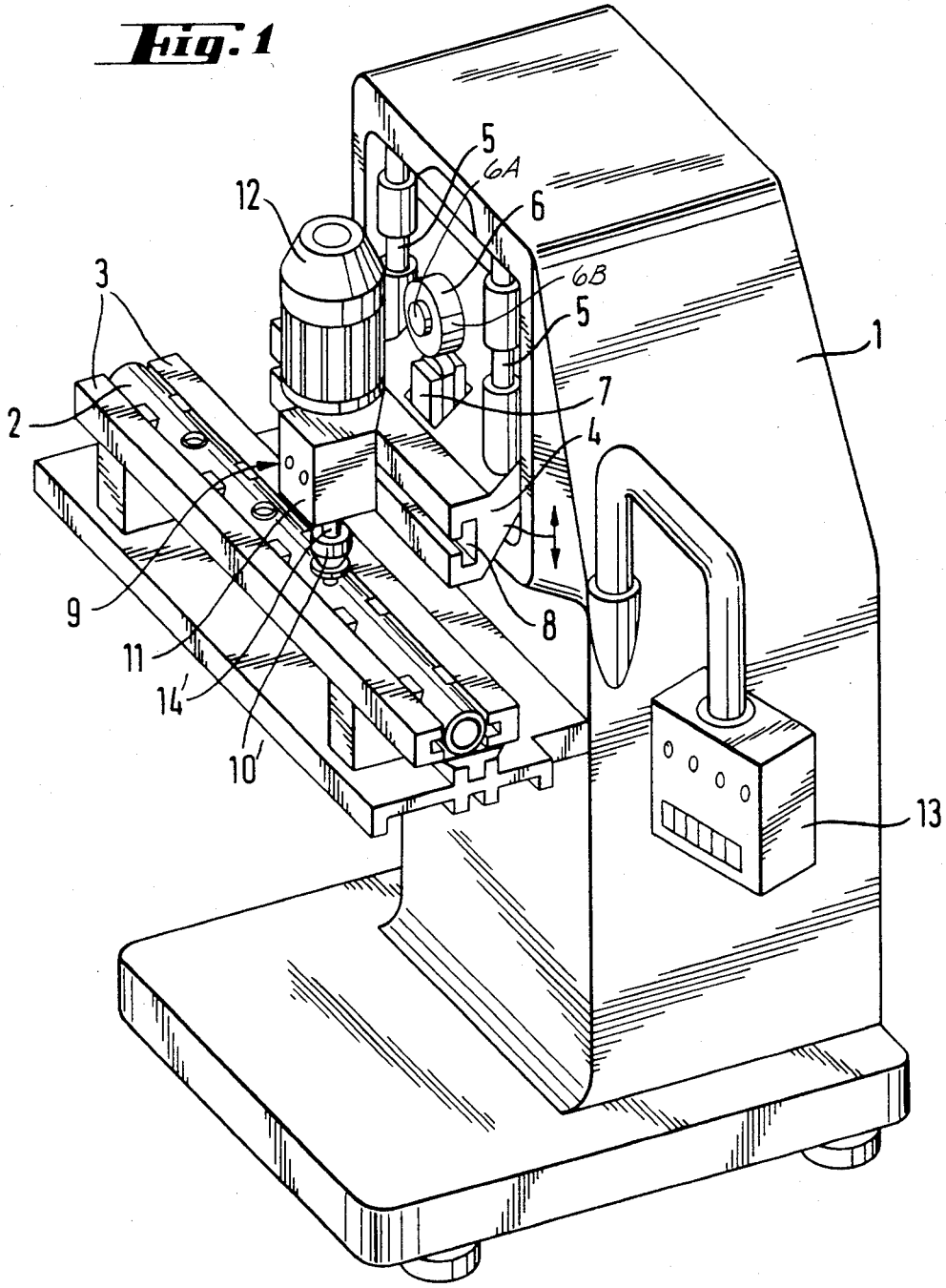
FIG. 1 is a perspective view of an apparatus of the invention.

The apparatus illustrated in FIG. 1 comprises a fixed stand 1 with a pipe 2 to be collared being supported by fastening means 3 for holding the pipe. Feed means has a slide 4 mounted on the stand by means of vertical runners 5, so that the slide 4 is capable of moving vertically relative to stand 1. The feed means also has an eccentric cam element or disk 6, having a cam surface 6B, secured to slide 4 which is reciprocally rotatable around a horizontal axis in the form of axle 6A and which supports the slide 4 on a bracket 7 mounted on stand 1. The slide 4 is provided with a groove 8 which has fitted therein a device, generally designated by reference numeral 9 and comprising a head element 10'. To be described in detail, the head element 10' comprises a combined collaring means and hole-making means. The device 9 further comprises a housing portion 11 with its reduction gear (not shown), and a motor indicated generally at 12 for rotating the head element 10'. The device 9 is drawn by its weight for hole-making, while the cam surface is adapted to limit the movement of the device during hole-making. The device 9 can be movable along the groove 8 or a plurality of said devices can be fitted successively in the groove 8 for simultaneous production of several collars, possibly of various sizes. A control unit 13 serves to actuate and stop the apparatus and contains a microprocessor-operated automatic control system for varying the rotational speed of the cam element 6 according to various programs.

In the embodiment of FIG. 1, the combined collaring means and hole-making means are integral with each other and are supported by the rest of the elements of device 9 and are rotated by motor 12.

Figure 3:
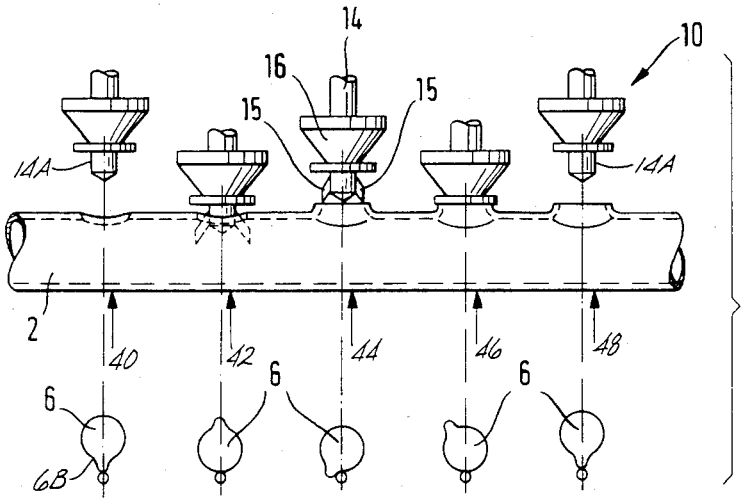
FIG. 3 shows a control over the vertical movement of collaring means in various collaring steps.

An alternate embodiment, shown in FIG. 3, depicts a collaring means 10 having a spindle 14, a jacket surface 14A of spindle 14, two pin-shaped forming means 15 and adjustment means 16. The collaring means of head element 10' (FIG. 1) is similar to collaring means 10 (FIG. 3), having pin-shaped forming means similar to 15 (FIG. 3) and adjustment means similar to 16 (FIG. 3), and the operation of the collaring means portion of head element 10' is similar to the collaring means 10 of FIG. 3.

As illustrated in FIG. 3, pin-shaped forming means 15 are connected to the spindle 14 so that they can be extended from the jacket surface 14A of spindle 14 by the adjustment means 16 or pulled inside the jacket surface, as described in more detail in the cited DE Patent publication No. 1 752 749. One possibility of automatically operating the adjustment means 16 is disclosed in U.S. Patent publication 3 884 060.

As disclosed in the cited references, a hole is formed prior to the collaring step by means of a drill bit formed in the head element 10' on the end of spindle 14'. The head element 10' is a combined hole-making means and collaring means which, on downward feed in a first direction makes a hole and on upward return or feed in a second direction makes a collar. The vertical force required on upward feed for moving the collaring means and for forming the collar during the collaring operation is provided through the cam surface 16B as the cam element rotates.

When making collars of rather large diameter, for which the present apparatus is primarily intended, a hole can be made not only by means of a combined head such as that disclosed in the Finnish Patent application No. 800278 corresponding to U.S. Pat. No. 4,389,866 but also by means of an individual head element or hole-making means designated in FIG. 2 and FIGS. 4–7 by reference numeral 20. Means are provided in the form of turret 17 or 17' for mounting the collaring means 10 and the hole-making means 20. Means, in the form of motor 18, is provided for rotating the collaring means 10 and hole-making means 20. The hole-making means 20 includes a hole-working means 21, which is the portion of the hole-making means 20 that contacts the pipe and makes the hole.

In order to have the outer edges of a collar, which are pulled or formed from the side of a cylindrical pipe, on substantially the same level, a hole must be of elliptical shape. To produce an elliptical hole, the hole-working means 21 is secured to the end of a rotatable drill spindle 22 (FIG. 2) and at a distance from a central rotational axis 23 of the spindle 22. The hole-working means 21 is directed at an acute angle relative to the central rotational axis 23. The hole-working means 21 comprises a cutter or grinding stone whose diameter is small with respect to the diameter of the hole to be worked and which is rotated around its axis 21A that lies at an acute angle relative to the central rotational axis 23 of spindle 22, the jacket surface or casing 21B of the cutter or grinding stone effecting the working action.

Preferably, the hole-making means, equipped with the hole-working means 21, and the collaring means 10, equipped with forming means 15, are secured to the turret 17 (FIGS. 4 and 5) or 17' (FIGS. 6 and 7) of the slide member 4. Rotation of the turret 17 about its vertical axis (as seen in FIGS. 4 and 5) brings the collaring means 10 and hole-making means 20 alternately to the same working position and enables the collaring means 10 and hole-making means 20 to be driven by the same drive motor 18. In FIG. 4, the hole-making means 20 and its associated hole-working means 21 are in action and the collaring means 10 is disengaged. By rotating the turret 17 around the vertical axis to the position shown in FIG. 5, the collaring means 10 with its forming means are in turn positioned for action or rotation by motor 18 and the hole-making means 20 is disengaged. In FIGS. 6 and 7, element 17' has been rotated around a horizontal axis (not shown) to engage or disengage the hole-making means 20 or the collaring means 10, respectively, with motor 18.

The cam element 6 in the feed means is driven by a variable-speed rotational drive motor 19. Motor 19 can be driven at a predetermined constant speed, the shape of cam member 6 dictating the vertical travelling speeds of slide 4 and its associated collaring means 10 and hole-making means 20 in various working steps. This simple embodiment can be employed when it is desired to use the combined head 10' of FIG. 1, as disclosed in U.S. Pat. No. 3,884,060, which on downward feed drills a hole and on upward feed forms a collar. In such a case, the shape of the cam varies the speed of the vertical displacement. Alternatively, when using a hole-making means 20 separate from the collaring means 10, as in FIG. 4, the feed means further comprises a digitally controlled step motor controlled by a microprocessor-operated control system for selecting the reciprocation speed and extent of motion of the cam element 6 according to a desired program. Thus, the cam element speed and vertical feed movements can be readily altered according to varying conditions, such as different pipe materials, different pipe diameters and collar sizes, etc. Therefore, the various steps of hole-forming and the various steps of collaring, and their associated speeds of operation, will be determined according to the varying conditions and will be controlled by the shape, reciprocation, rotational speed and extent of motion of the cam element.

Figure 2:
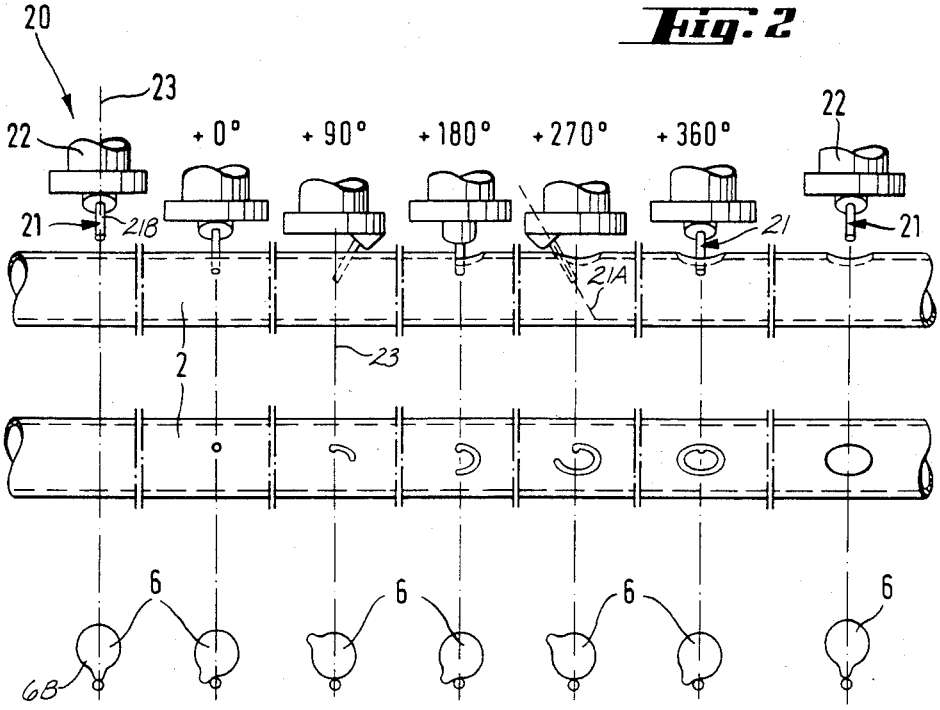
FIG. 2 illustrates various hole-forming steps when using means of a preferred embodiment of the invention for working a hole in the side of a pipe.

FIG. 2 shows the control by the cam element 6 over the vertical movements of hole-making means 20 during various hole-making steps. By virtue of the illustrated vertical control pattern, it is possible to produce a more nearly elliptical hole than without vertical control. This is more clearly understood by noting that when the hole-making means 20 is completely descended, at 90° rotation of drill spindle 22 (FIG. 2), the hole-working means 21 works by its base, i.e. as far away as possible from the central rotational axis 23 of drill spindle 22. Conversely, when the hole-making means 20 is only partially descended, at 180° rotation of drill spindle 22 (FIG. 2), during the work on the sides of a pipe, the hole-making means 20 is slightly raised, the active or working portion of the hole-working means 21 being closer to central rotational axis 23.

On the other hand, FIG. 3 illustrates the controlled actuation of cam element 6 for the collaring operation, beginning with instant movement of the collaring means 10 from the initial position shown generally at 40 to the collaring position 42 followed by slow lift movement or upward feed during the collaring 44, then quick downward movement and stop in the position for levelling the top edge of a collar 46 and, finally, instant lift into the initial position 48.

It can be appreciated that by means of a stucturally simple arrangement it is possible to accurately steer and control the feed movements necessary for various steps of operation. It is obvious that this can be accomplished with a plurality of structural embodiments within the basic idea of the invention. Thus, cam element 6 need not necessarily be rotatable but it can be, e.g., a reciprocating profile element having a suitably shaped guide surface, the reciprocating speed determining the rates of operation of the apparatus.

In the above-described embodiments, the hole-making means and the collaring means are mounted on the stand for moving relative thereto and to the pipe-fastening means. On the other hand, it is possible to employ a reversed arrangement in such a manner that the hole-making means 20 and the collaring means 10 are fixedly secured to the stand of the machine with the pipe-fastening means 3 secured to the slide element 4. In such a case, the mounting means for both the hole-making and the collaring means are stationary and the pipe-fastening means moves relative to the stand. However, movements of the pipe-fastening means are controlled the same way.

What is claimed is:

1. An apparatus for making a hole, having an axis, and a collar therefor in the side of a pipe, the apparatus comprising:

a stand;

pipe-fastening means mounted on the stand for holding the pipe;

means for making a hole having edges in the pipe during movement of the hole-making means in a first direction;

means for collaring the edges of the hole during movement of the collaring means in a second direction;

means mounted on the stand for mounting and rotating the hole-making means and for mounting and rotating the collaring means, the means for mounting and rotating the hole-making means being drawn by its weight, in the first direction, for hole-making; and variable-speed feed means comprising a cam element for effecting a relative vertical displacement between the mounting and rotating means and the pipe-fastening means, the feed means further comprising a cam surface on the cam element for forcing the collaring means to move in the second direction during a collaring operation, the cam surface being adapted to limit the movement of the mounting and rotating means in the first direction during the hole-making.

2. The apparatus as claimed in claim 1 wherein the cam element has a shape for varying the speed of relative vertical displacement between the mounting and rotating means and the pipe-fastening means.

3. The apparatus as claimed in either of claims 1 or 2 wherein the feed means comprises a control for varying the speed of the cam element to thereby vary the speed of the relative vertical displacement between the mounting and rotating means and the pipe-fastening means.

4. The apparatus as claimed in claim 1 wherein the cam element has a shape for varying the speed of vertical displacement and the feed means comprises a control for varying the speed of the cam element to thereby vary the speed of the relative vertical displacement between the mounting and rotating means and the pipe-fastening means.

5. The apparatus as claimed in claim 1 wherein the hole-making means is integral with the collaring means.

6. The apparatus as claimed in claim 1 wherein the hole-making means is spaced apart from the collaring means.

7. The apparatus as claimed in claim 1 wherein the pipe-fastening means is stationary relative to the stand while the mounting and rotating means moves the hole-making and the collaring means relative to the pipe-fastening means and the stand.

8. The apparatus as claimed in claim 1 wherein the cam element comprises a rotatable eccentric cam disk.

9. The apparatus as claimed in claim 5 having various steps of operation and various speeds for the various steps of operation, wherein the cam element is rotatable at a constant speed and comprises a shape wherein the shape of the cam element dictates the various speeds of the various steps of operation.

10. The apparatus as claimed in claim 1 wherein the cam element is reciprocally movable for operating the feed means at various speeds.

11. The apparatus as claimed in claim 1 wherein the cam element comprises a reciprocally rotatable cam element rotatable at various rotation speeds and for various extents of rotation.

12. The apparatus as claimed in any of claims 1, 6 or 8 wherein the hole-making means and the collaring means are spaced apart, the means for mounting and rotating the hole-making means comprising:

a spindle rotating about a first central rotational axis; and the hole-making means comprising a hole-working means having a first end secured at an angle to the spindle at a point spaced apart from the first central rotational axis and a free second end directed toward and at an acute angle relative to the central rotational axis.

13. The apparatus as claimed in claim 12, the hole having a diameter and a second central axis extending from the midpoint of the diameter parallel to the first central rotational axis, wherein the hole-working means comprises a cutter having a small diameter relative to the diameter of the hole and a casing such that the casing produces a working action against the pipe.

14. The apparatus as claimed in claim 1 having a working position and wherein the mounting and rotating means comprises a turret for mounting the hole-making means and the collaring means on the turret spaced apart from each other whereby rotation of the turret brings the hole-making means and the collaring means alternately into the working position.

15. An apparatus as claimed in claim 1 wherein the first and second directions are in opposite directions.

* * * * *